US011079190B2

(12) United States Patent
Hudson, III et al.

(10) Patent No.: US 11,079,190 B2
(45) Date of Patent: Aug. 3, 2021

(54) FIREARMS RECOIL SPRING INSERT AND RECOIL SPRING INSERT ASSEMBLY

(71) Applicant: Daniel Defense LLC, Black Creek, GA (US)

(72) Inventors: Billie Cyril Hudson, III, Georgetown, TX (US); Lauren Hudson, Georgetown, TX (US); Kevin Michael Blanford, Louisville, KY (US)

(73) Assignee: Daniel Defense, LLC, Black Creek, GA (US)

( * ) Notice: Subject to any disclaimer, the term of this patent is extended or adjusted under 35 U.S.C. 154(b) by 0 days.

(21) Appl. No.: 15/790,874

(22) Filed: Oct. 23, 2017

(65) Prior Publication Data

US 2018/0164058 A1 Jun. 14, 2018

Related U.S. Application Data

(60) Provisional application No. 62/411,931, filed on Oct. 24, 2016.

(51) Int. Cl.
*F41A 3/86* (2006.01)
*F41A 3/66* (2006.01)

(52) U.S. Cl.
CPC . *F41A 3/86* (2013.01); *F41A 3/66* (2013.01)

(58) Field of Classification Search
CPC ..... F41A 3/86; F41A 3/66
USPC ..... 42/1.06
See application file for complete search history.

(56) References Cited

U.S. PATENT DOCUMENTS

| | | | | | |
|---|---|---|---|---|---|
| 2,139,203 | A * | 12/1938 | Petter | F41A 5/04 | 42/69.03 |
| 3,756,121 | A * | 9/1973 | Roy | F41A 3/86 | 89/196 |
| 3,901,125 | A * | 8/1975 | Raville | F41A 3/86 | 42/1.05 |
| 4,485,723 | A * | 12/1984 | Sarony | F41A 3/86 | 89/163 |
| 6,129,000 | A * | 10/2000 | Schmid | F41A 3/16 | 89/187.01 |
| 6,234,059 | B1 * | 5/2001 | Fuchs | F41A 3/66 | 89/195 |
| 2005/0247187 | A1 * | 11/2005 | McGarry | F41A 3/86 | 89/198 |
| 2016/0245602 | A1 * | 8/2016 | Hangen | F41A 3/86 | |
| 2017/0122682 | A1 * | 5/2017 | Mantas | F41A 3/86 | |
| 2018/0073825 | A1 * | 3/2018 | Zukowski | F41A 3/86 | |

* cited by examiner

*Primary Examiner* — Bret Hayes
(74) *Attorney, Agent, or Firm* — Eversheds Sutherland (US) LLP

(57) ABSTRACT

A recoil spring assembly for a firearm provides a spring insert with an end piece. The end piece interacts with other components of the firearm to selectively secure the recoil spring in position. This allows the recoil spring to be selectively retained in the firearm when disassembling and reassembling the firearm.

5 Claims, 7 Drawing Sheets

FIREARMS RECOIL SPRING INSERT AND RECOIL SPRING INSERT ASSEMBLY

CROSS-REFERENCE TO RELATED APPLICATIONS

The present application is related to, is a non-provisional of, and claims the benefit of and priority from U.S. provisional patent application Ser. No. 62/411,931, filed Oct. 24, 2016, by the same inventors and having the same title, the disclosure of which is incorporated herein by reference.

TECHNICAL FIELD

This disclosure relates generally to firearms and more particularly to a recoil spring insert and spring insert assembly for a pistol.

BACKGROUND

The recoil spring of firearms, and pistols in particular, is positioned horizontally under the barrel. It attenuates the recoil action from discharging a round from a firearm and also restores the firearm slide to its starting position after a cartridge is ejected from the firing chamber.

Firearms are disassembled to be cleaned, among other reasons. The recoil spring often presents a challenge when a firearm is disassembled because if tends to fall out of the grip and it also difficult to hold in place while reassembling the firearm after cleaning. Although some previous firearms designs capture the recoil spring in the grip or slide of the firearm, the present invention provides an improved assembly to selectively capture the recoil spring.

SUMMARY

The recoil spring assembly of the present invention provides a spring insert with an end piece. The end piece interacts with other components of the firearm to selectively secure the recoil spring in position. This allows the recoil spring to be selectively retained in the firearm when the slide and barrel are removed from the grip, most often for cleaning.

A principal advantage of the recoil spring assembly of the present invention is that the operator does not have to fumble to manually hold the spring in place in the grip while already simultaneously holding the grip and the slide with two hands to reassemble the slide into position on the grip. The present assembly obviates the need for a third hand to hold the recoil spring.

BRIEF DESCRIPTION OF THE DRAWINGS

For a more complete understanding of the present disclosure, and the advantages thereof, reference is now made to the following descriptions taken in conjunction with the accompanying drawings, in which.

DETAILED DESCRIPTION

The following discussion is directed to various embodiments of the invention. The term "invention" is not intended to refer to any particular embodiment or otherwise limit the scope of the disclosure. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

In the following discussion and in the claims, the terms "including" and "comprising" are used in an open-ended fashion, and thus should be interpreted to mean "including, but not limited to . . . ." Also, the term "connect" or "connected" where used if at all is intended to mean either an indirect or direct connection. Thus, if a first component connects to a second component, that connection may be through a direct connection or through an indirect connection via other components and connections.

Certain terms are used throughout the following description and claims to refer to particular system components and method steps. As one skilled in the art will appreciate, different companies may refer to a component by different names. This document does not intend to distinguish between components that differ in name but not function.

Figure 1:
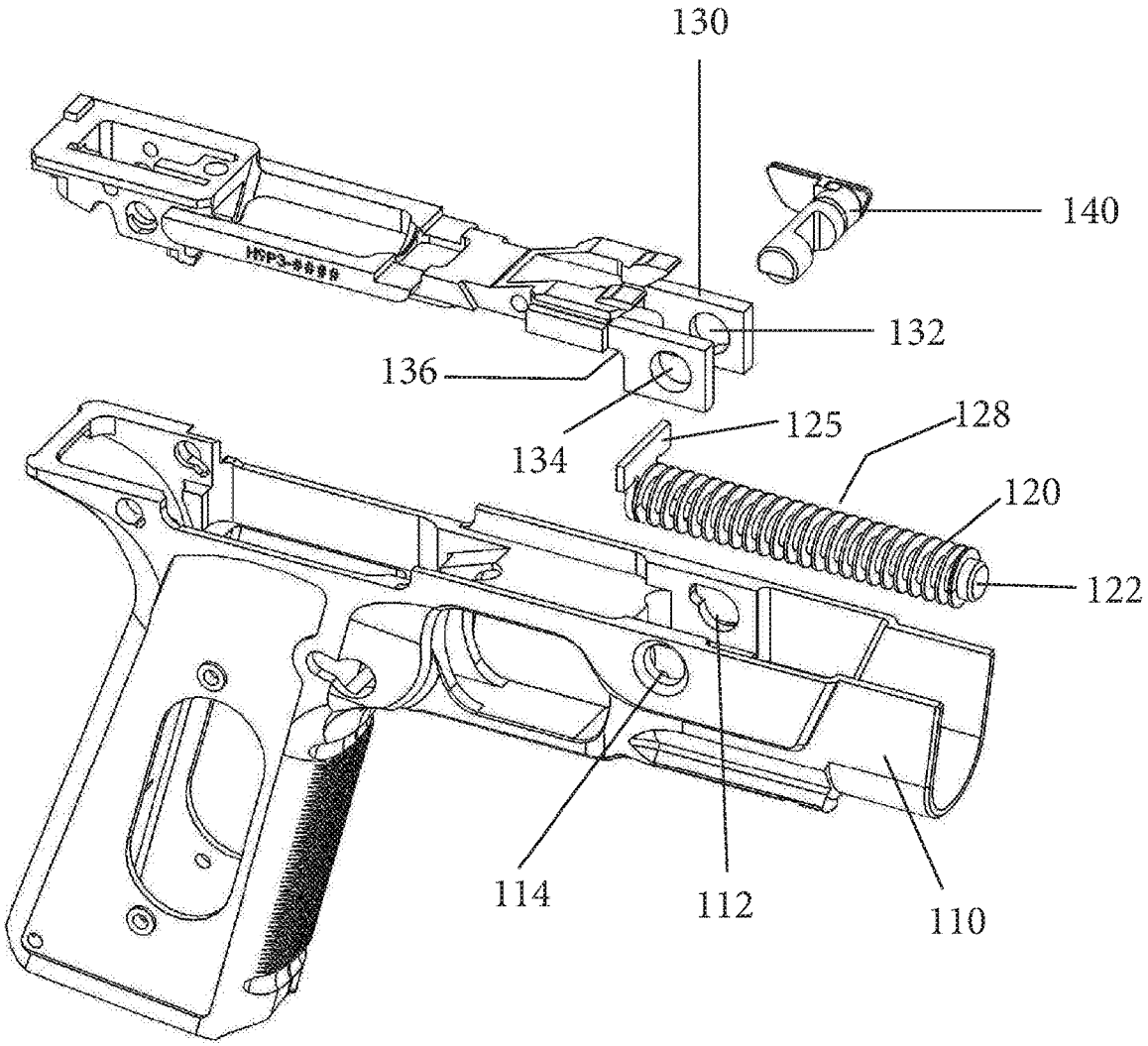
FIG. 1 is a perspective exploded side view of a recoil spring assembly of the present invention.

FIG. 1 is a perspective exploded side view of a recoil spring assembly of the present invention. Grip 110 houses grip insert 130, which provides bores 132/134 to receive pin 140. Grip insert 130 provides surface 136 which has a curved portion that defines an upper horizontal portion and a lower vertical portion. Recoil spring 120 is housed in grip 110 beneath pin 140 receiving bores 112/114. Recoil spring 120 houses spring insert 122, which provides end piece 125, to form a recoil spring assembly 128 comprising spring insert 122 having end piece 125 housed in spring 120.

Figure 2:
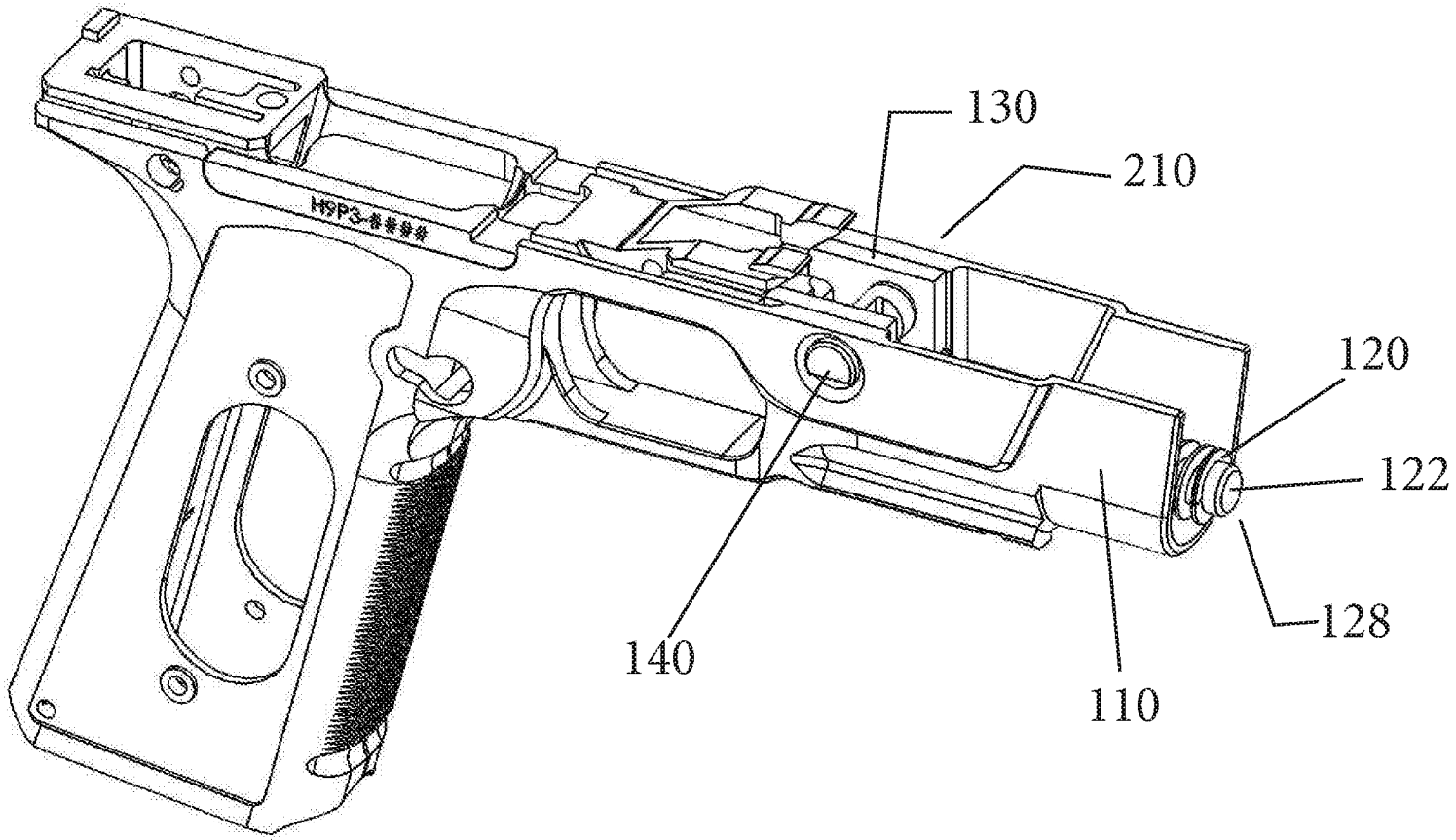
FIG. 2 is a perspective side view of an assembled recoil spring assembly of FIG. 1.

FIG. 2 is a perspective side view of an assembled recoil spring assembly of FIG. 1. Assembly 210 comprises grip 110 which houses recoil spring 120 and grip insert 130. Pin 140 is inserted through grip bores 112/114 and grip insert bores 132/134 (see FIG. 1) to retain recoil spring assembly 128.

Figure 3:
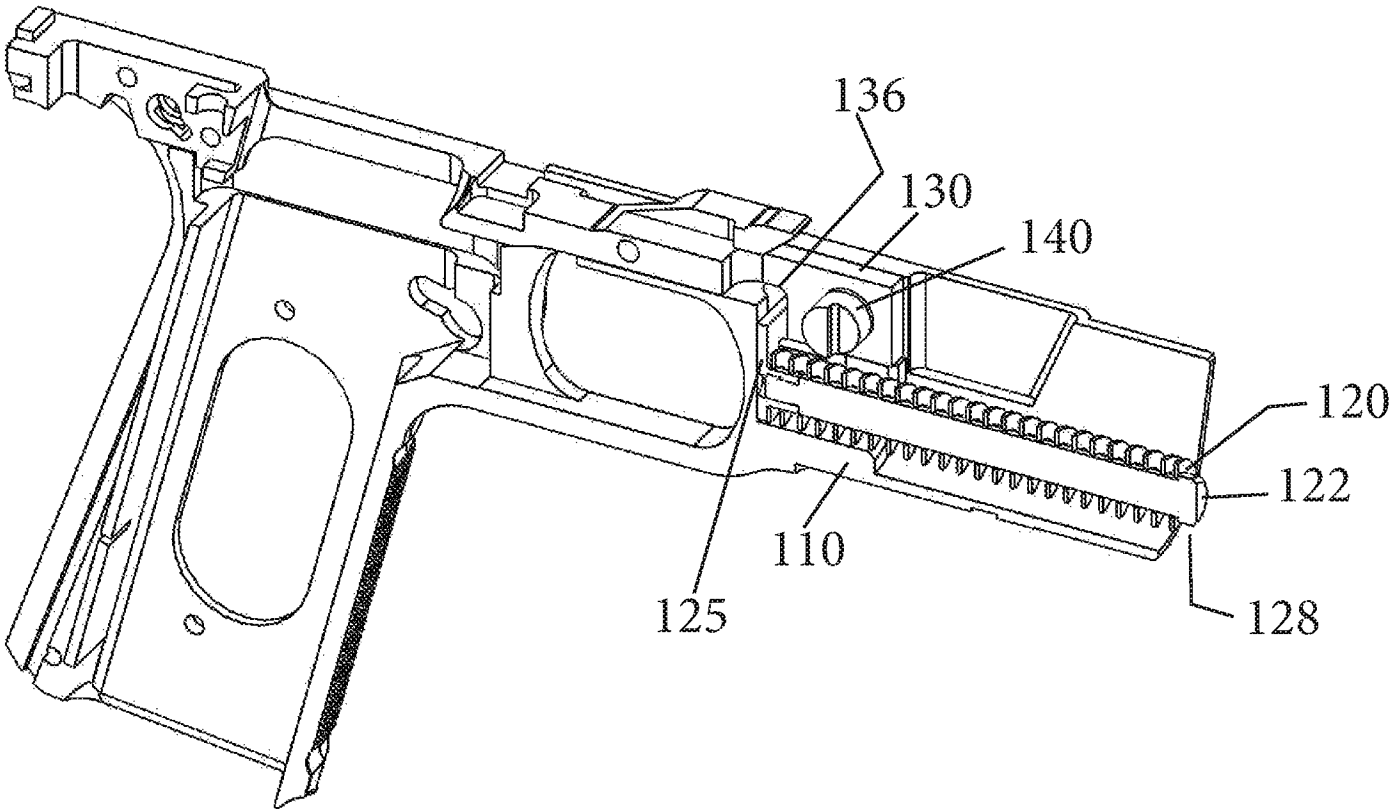
FIG. 3 is a perspective right-side cross-section view of a recoil spring assembly of the present invention.

FIG. 3 is a perspective right-side cross-section view of a recoil spring assembly of the present invention. Recoil spring assembly 128 is disposed in grip 110 beneath pin 140. End piece 125 is oriented to be captured by grip insert 130 along the vertical portion of surface 136 so as to retain spring 120 in grip 110 even if pin 130 were to be removed.

Figure 4:
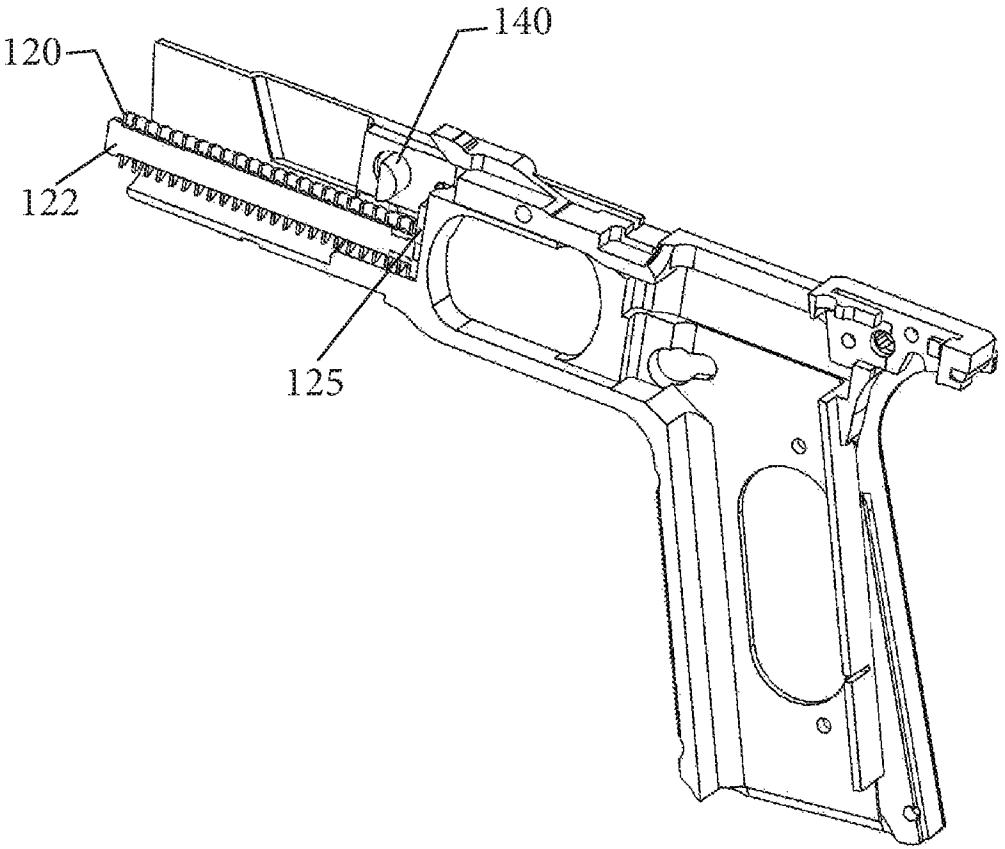
FIG. 4 is a perspective left-side cross-section view of a recoil spring assembly of FIG. 3.

FIG. 4 is a perspective left-side cross-section view of a recoil spring assembly of FIG. 3. Recoil spring 120 is disposed in grip 110 beneath pin 140. End piece 125 of spring insert 122 secures spring 120 in position.

Figure 5:
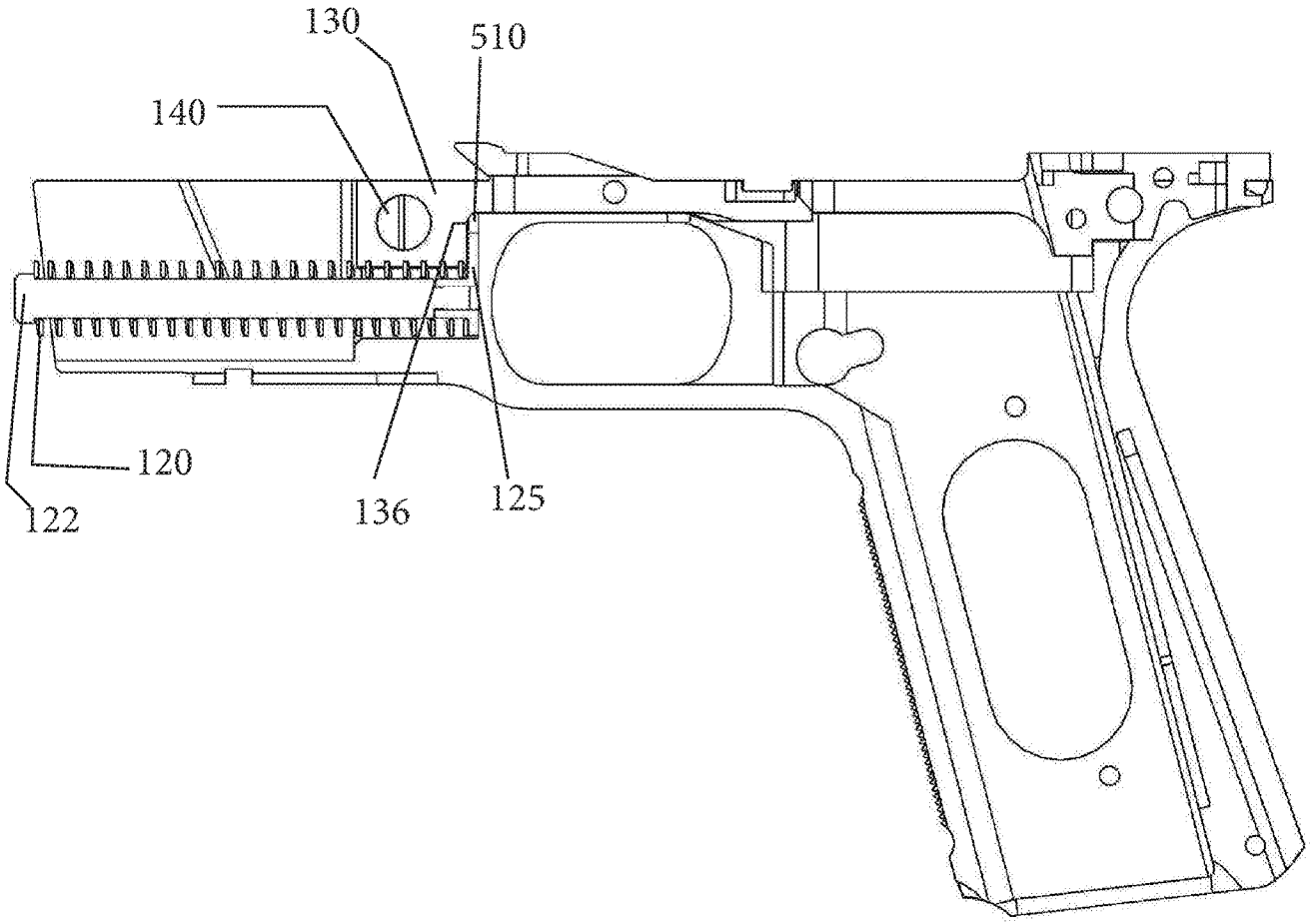
FIG. 5 is a left-side cross-section view of a recoil spring assembly of FIG. 4.

FIG. 5 is a left-side cross-section view of a recoil spring assembly of FIG. 4. End piece 125 is captured in space or slot 510 formed by surface 136 of grip insert 130.

Figure 6:
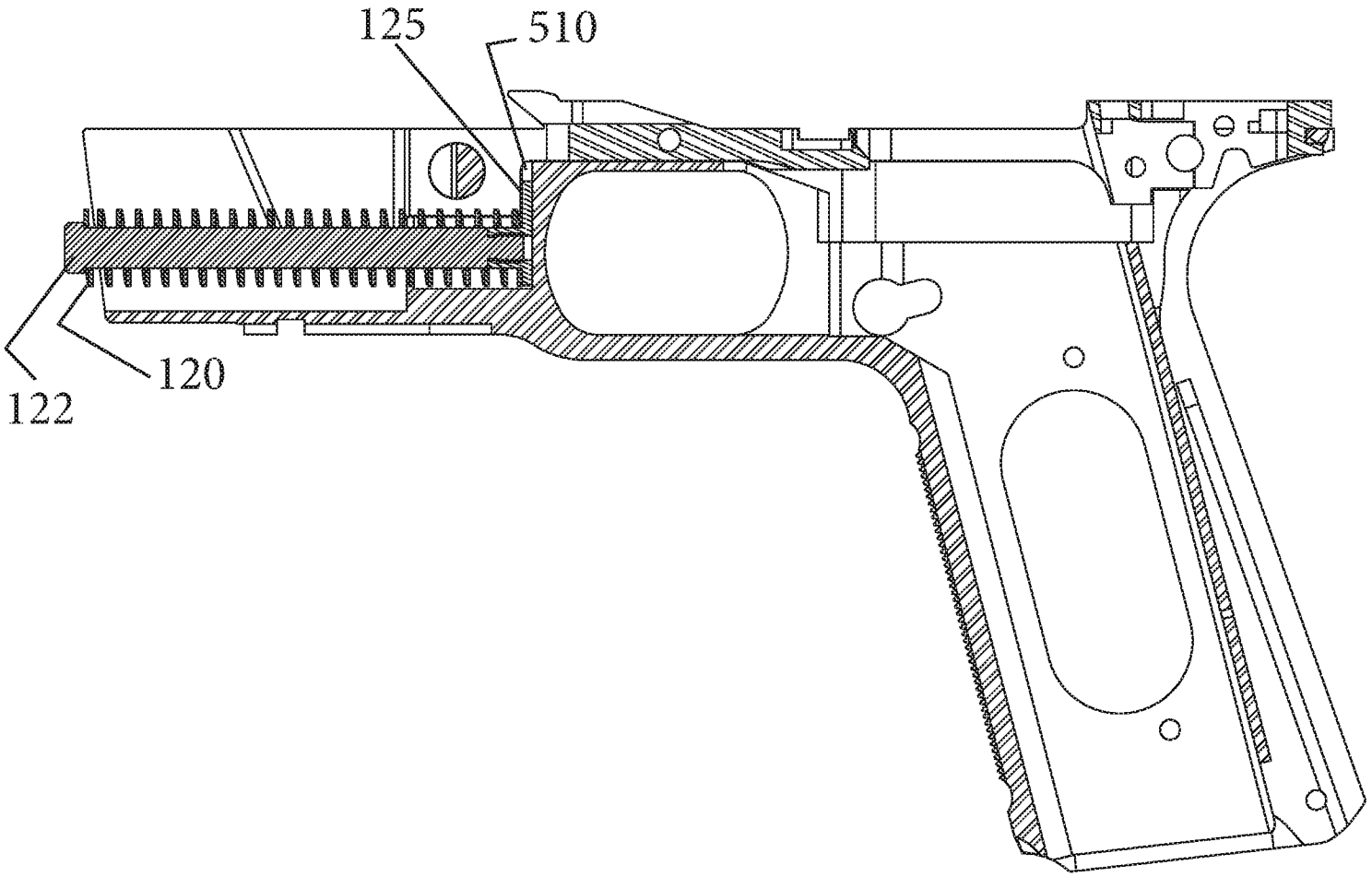
FIG. 6 is a left-side cross-section alternative view of a recoil spring assembly of FIG. 4.

FIG. 6 is a left-side cross-section alternative view of a recoil spring assembly of FIG. 4. End piece 125 is oriented to fit into space or slot 510 to retain spring 120 in position.

Figure 7:
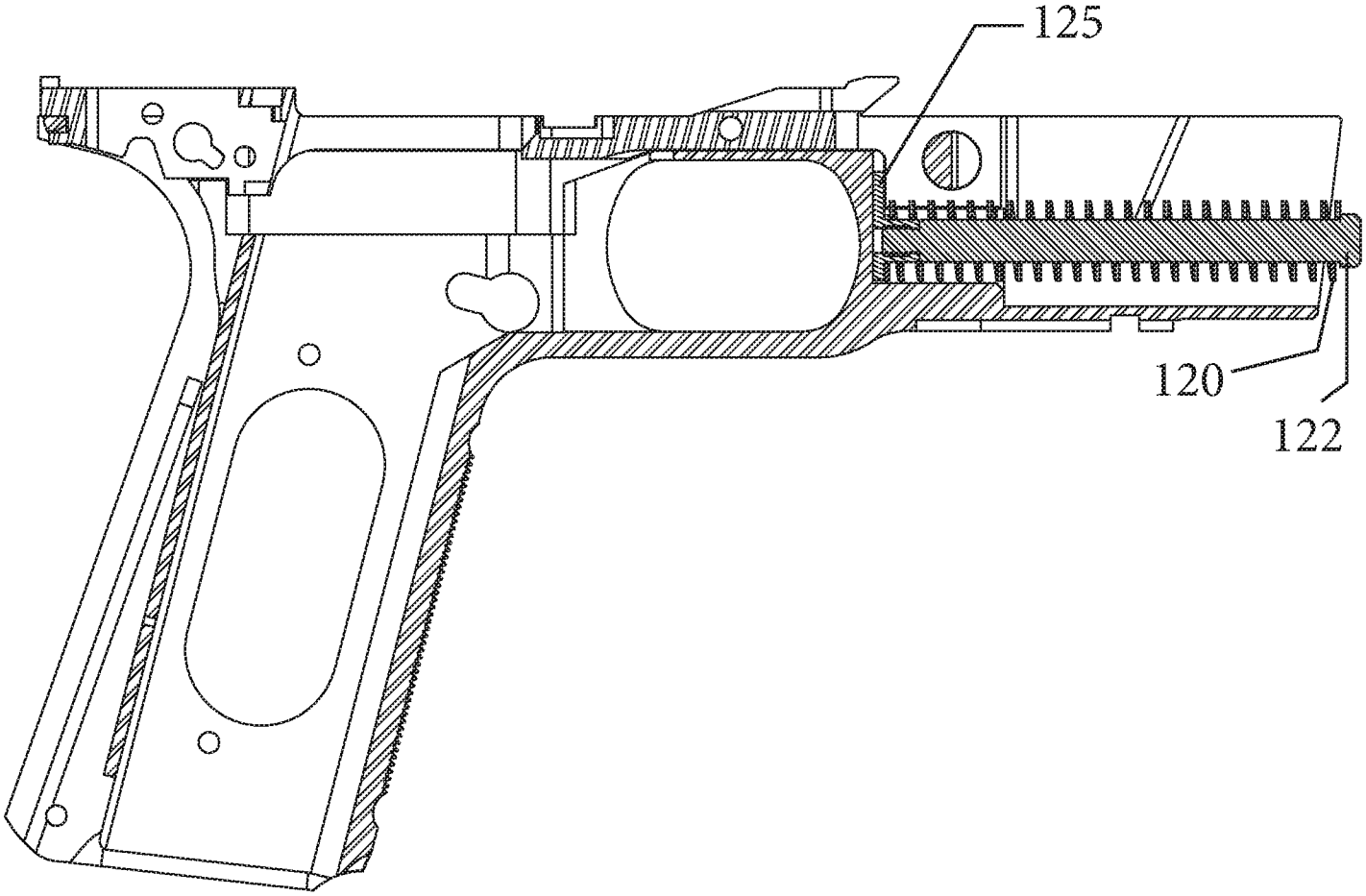
FIG. 7 is a right-side cross-section alternative view of a recoil spring assembly of FIG. 3.

FIG. 7 is a right-side cross-section alternative view of a recoil spring assembly of FIG. 3. End piece 125 of spring insert 122 retains spring 120 in position.

Spring insert 122 is selectively disengaged from slot 510 by removing pin 140. With pin 140 removed, grip insert 130 can be rotated to release spring insert 122 from slot 510 of grip insert 130. To selectively engage spring insert 122 with slot 510, restore spring insert 122 to its position in grip 110 and rotate grip insert 130 to engage end piece 125 in slot 510. When end piece 125 is engaged with slot 510, spring 120 is secured in the firearm. When end piece 125 is not engaged with slot 510, spring 120 is not secured to the firearm and maybe be removed from the firearm by the user if so desired.

Many modifications and other embodiments of the recoil spring insert described herein will come to mind to one skilled in the art to which this disclosure pertains having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A firearm comprising:

a recoil spring comprising coils forming a tunnel;

a recoil spring insert disposed in the tunnel, the recoil spring insert comprising:

a main body that fits inside the tunnel, the main body having a proximate end, wherein the main body defines a horizontal axis; and an end piece on the proximate end of the main body, the end piece comprising an extended portion connected to and extending above the end such that the extended portion extends perpendicular to and above the horizontal axis; and a grip insert comprising a surface shaped to form a slot extending perpendicular to and above the horizontal axis, wherein the slot is configured to receive and secure the extended portion of the end piece of the recoil spring insert.

2. The firearm of claim 1, further comprising a grip comprising a bore.

3. The firearm of claim 2, wherein the grip insert comprises a bore.

4. The firearm of claim 3, further comprising a pin configured to extend through the bore of the grip and the bore of the grip insert.

5. The firearm of claim 4, wherein the extended portion is configured to disengage with the slot when (i) the pin is removed from the bore of the grip and the bore of the grip insert and (ii) the grip insert is rotated to release the extended portion from the slot.

* * * * *